US006820722B2

(12) United States Patent
Severt

(10) Patent No.: US 6,820,722 B2
(45) Date of Patent: Nov. 23, 2004

(54) DEVICE FOR USE IN ERECTING ROOF TRUSSES

(76) Inventor: Ricky Dean Severt, P.O. Box 713, Miller's Creek, NC (US) 28651

( * ) Notice: Subject to any disclaimer, the term of this patent is extended or adjusted under 35 U.S.C. 154(b) by 0 days.

(21) Appl. No.: 10/349,417

(22) Filed: Jan. 22, 2003

(65) Prior Publication Data

US 2003/0136609 A1 Jul. 24, 2003

Related U.S. Application Data

(60) Provisional application No. 60/351,337, filed on Jan. 23, 2002.

(51) Int. Cl.[7] ..... E04G 3/00; E04G 3/10; E04G 3/08

(52) U.S. Cl. ..... 182/82; 182/150; 182/206; 182/45; 248/237; 52/749.12

(58) Field of Search ..... 182/150, 82, 45, 182/206, 127; 248/237, 201, 215, 343; 52/749.12, 748.11, 748.111, 127.2, 127.11

(56) References Cited

U.S. PATENT DOCUMENTS

| | | | | | |
|---|---|---|---|---|---|
| 182,062 | A | * | 9/1876 | Cornwell | 248/343 |
| 1,115,803 | A | | 11/1914 | Gallagher | |
| 1,340,191 | A | * | 5/1920 | Udovich | 182/150 |
| 1,369,747 | A | * | 2/1921 | Jordan | 248/343 |
| 1,436,977 | A | * | 11/1922 | Baker | 182/150 |
| 1,662,859 | A | * | 3/1928 | Johnston | 182/150 |
| 2,009,861 | A | * | 7/1935 | Skinner | 182/150 |
| 2,167,794 | A | * | 8/1939 | Bentz | 248/339 |
| 2,878,078 | A | | 3/1959 | Moultrop | |
| 3,892,290 | A | * | 7/1975 | Lang | 182/206 |
| 4,570,749 | A | * | 2/1986 | McKibbin | 182/150 |
| 4,782,916 | A | | 11/1988 | Hays | |
| 4,907,674 | A | | 3/1990 | Miller | |
| 4,947,961 | A | | 8/1990 | Dudley | |
| 5,111,909 | A | | 5/1992 | Liu | |
| 5,148,890 | A | * | 9/1992 | Sipe | 182/45 |
| 5,239,790 | A | | 8/1993 | Fetzer | |
| 5,255,757 | A | * | 10/1993 | Horowitz et al. | 182/127 |
| 5,427,344 | A | * | 6/1995 | Beauchemin | 182/150 |
| 6,227,330 | B1 | | 5/2001 | Preusser et al. | |
| 6,401,861 | B1 | * | 6/2002 | Marszalek | 182/206 |
| 6,422,339 | B1 | * | 7/2002 | Wisler | 182/82 |
| 6,494,291 | B2 | * | 12/2002 | Ono | 182/82 |

* cited by examiner

*Primary Examiner*—Hugh B. Thompson, II
(74) *Attorney, Agent, or Firm*—Alston & Bird LLP

(57) ABSTRACT

A device for erecting roof comprises a portable platform of a size and weight easily lifted and manipulated by a single worker. The platform is configured to fit over the upper ends of the chords of a truss that has already been secured in place so that it can support a worker. By using a pair of the devices, the worker can move from truss to truss, from one end of the roof to the other. The worker moves the device that is not currently in use from one truss to the truss that he has just finished securing in place, and then steps from the device currently in use onto the other device so that the worker is supported on the newly secured truss, in position to guide a new truss into position so that it can be secured. This process is repeated until all trusses have been secured.

9 Claims, 6 Drawing Sheets

DEVICE FOR USE IN ERECTING ROOF TRUSSES

CROSS-REFERENCE TO RELATED APPLICATION

The present application claims the benefit of U.S. Provisional Patent Application Ser. No. 60/351,337 filed Jan. 23, 2002.

FIELD OF THE INVENTION

The present invention relates to building construction, and more particularly to a device that aids a worker in erecting roof trusses atop a building being framed.

BACKGROUND OF THE INVENTION

The construction of the frame of a conventional building such as a wood-frame house or the like generally starts with the construction of the wall sections. Once the wall sections have been built and attached to the foundation and to one another, the roof frame is then erected atop the walls. A roof frame conventionally is formed of a series of spaced-apart trusses, typically of generally triangular shape, that are attached atop the walls. The trusses define the overall shape of the roof, in terms of its pitch and so forth, and form the structural supports for other frame members that are attached to the trusses, such as a ridge beam that extends along the ridge of the roof.

The conventional process for erecting trusses is awkward at the least, and can be hazardous for the workers who must clamber atop the roof and receive a truss from an overhead crane. The workers must guide the truss into proper position and then must secure the truss in position by nailing wood supports between the newly erected truss and a previously secured one.

SUMMARY OF THE INVENTION

The present invention was developed to facilitate the process of erecting roof trusses. A device in accordance with the invention comprises a portable platform of a size and weight easily lifted and manipulated by a single worker. The platform is configured to fit over the upper ends of the chords of a truss that has already been secured in place so that it can support a worker. A worker can stand on the platform, which positions the worker in a suitable position to be able to work on an adjacent truss that is not yet secured. By using a pair of the devices, the worker can move from truss to truss, from one end of the roof to the other. When the worker is finished securing a truss, he moves the device that is not currently in use from one truss to the truss that he has just finished securing in place, and then steps from the device currently in use onto the other device so that the worker is then supported on the newly secured truss and in position to guide a new truss into position so that it can be secured. This process is repeated until all trusses have been secured.

In accordance with a preferred embodiment of the invention, the device comprises a base for the worker to stand on, and a pair of support arms attached to the platform adjacent one end thereof. The support arms extend upward from the platform. The upper ends of the support arms are attached to or define truss grips configured to fit over the tops of the truss chords on opposite sides of the peak so as to suspend the platform from the truss. The support arms and truss grips are sufficiently rigid and fit closely over the chords such that the support arms remain substantially vertical and the platform remains substantially horizontal when a worker is supported on the platform, using only the support provided by the chords. This is important because trusses in some cases do not have any vertical members against which the lower portion of the device can abut to resist rotation of the device as a result of the worker's weight on the platform. Because the platform is located to one side of the truss, the worker's weight exerts a moment on the device tending to rotate the device about the chords of the truss. This moment is resisted entirely by the engagement between the support arms and truss grips and the chords of the truss.

The invention also encompasses a method of erecting trusses, in which a first platform is suspended from a first truss that has been secured in place, a worker stands on the platform and secures a second truss in place adjacent the first truss, the worker suspends a second platform from the second truss and steps onto the second platform, the worker secures a third truss in place adjacent to the second truss, and the worker then moves the first platform from the first truss onto the third truss.

BRIEF DESCRIPTION OF THE DRAWINGS

The above and other objects, features, and advantages of the invention will become more apparent from the following description of certain preferred embodiments thereof, when taken in conjunction with the accompanying drawings in which.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
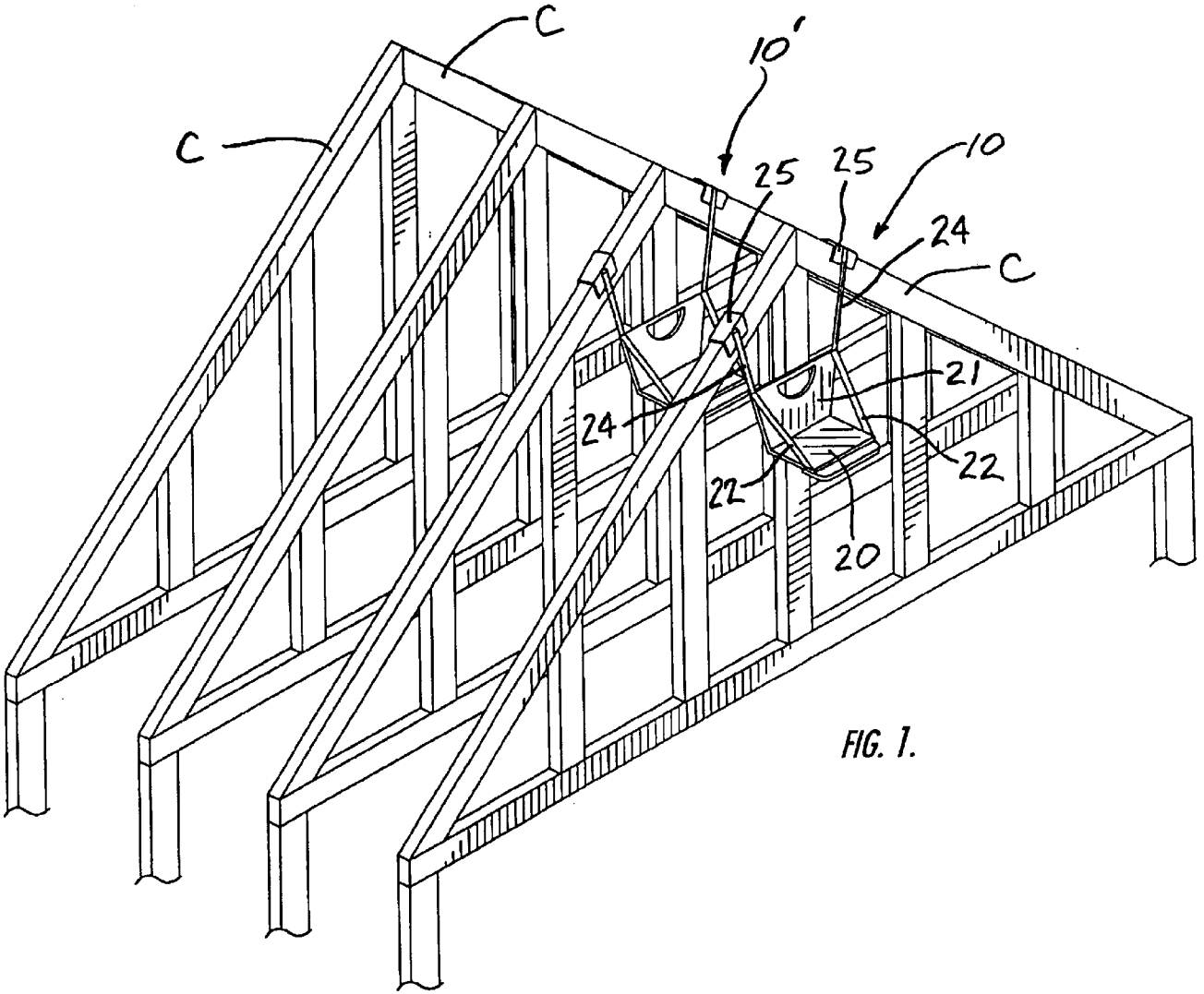
FIG. 1 is a perspective view of a series of trusses two of which support a pair of devices in accordance with the invention.
Figure 2:
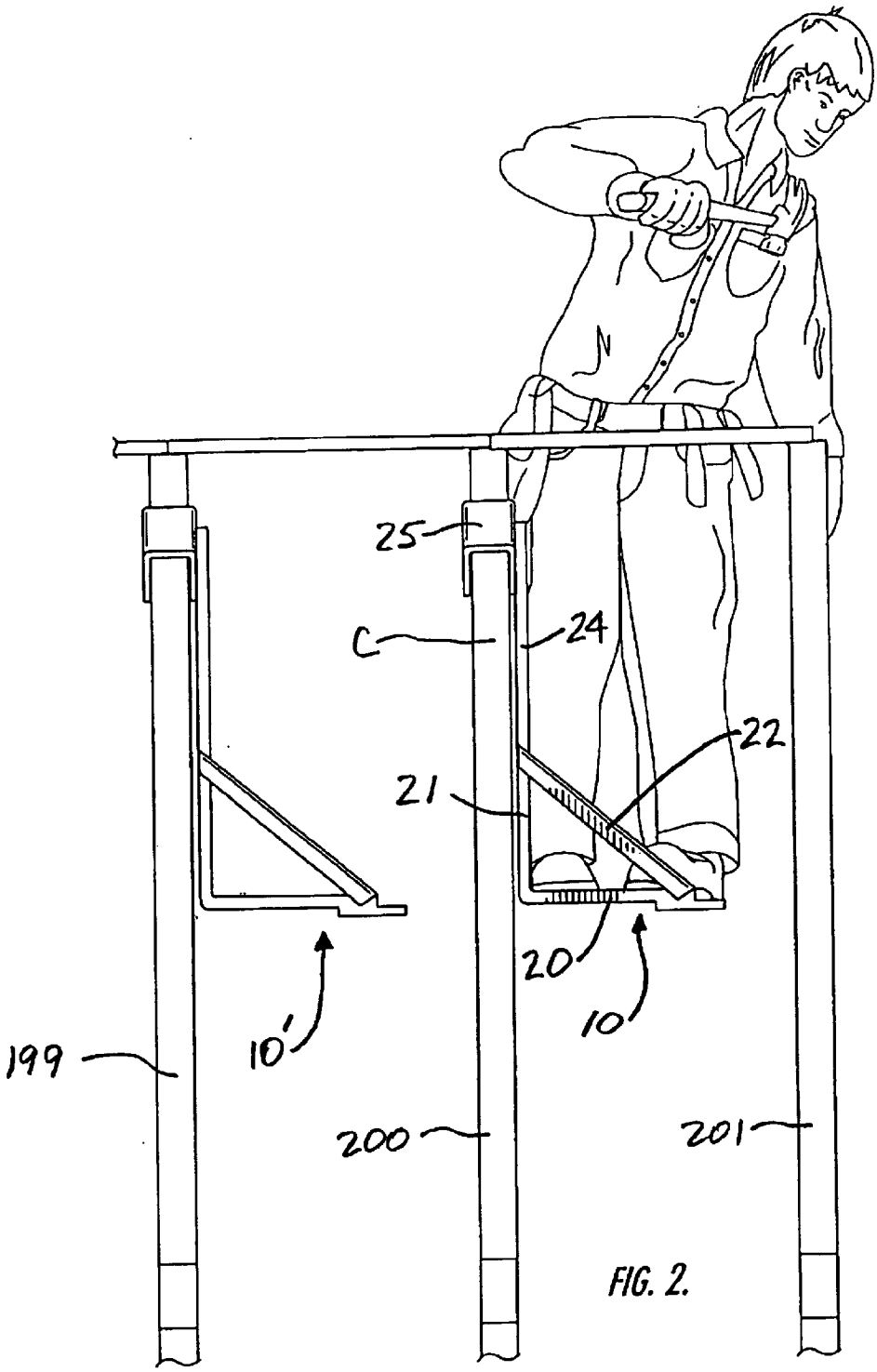
FIG. 2 is a side view showing a worker standing on one device and securing a truss in position.
Figure 3:
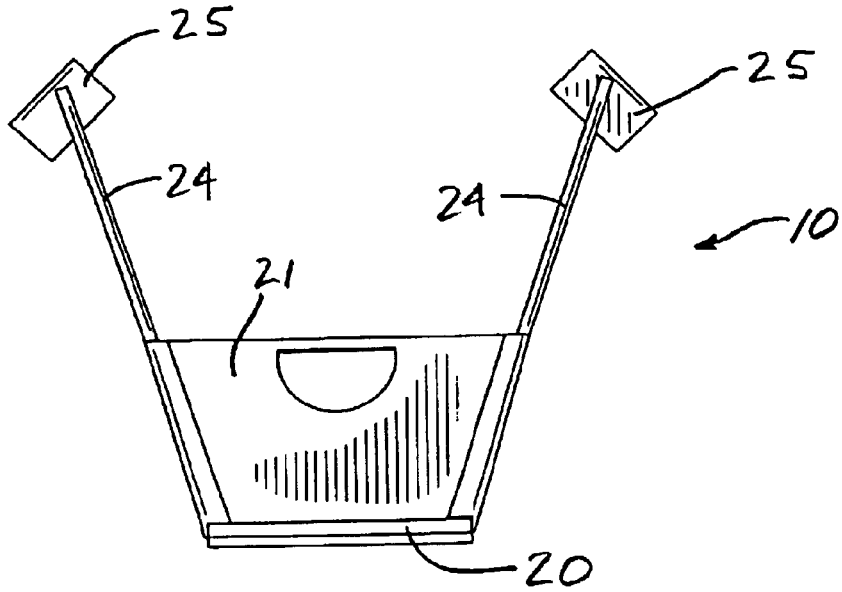
FIG. 3 is a front elevation of a device in accordance with one embodiment of the invention.
Figure 4:
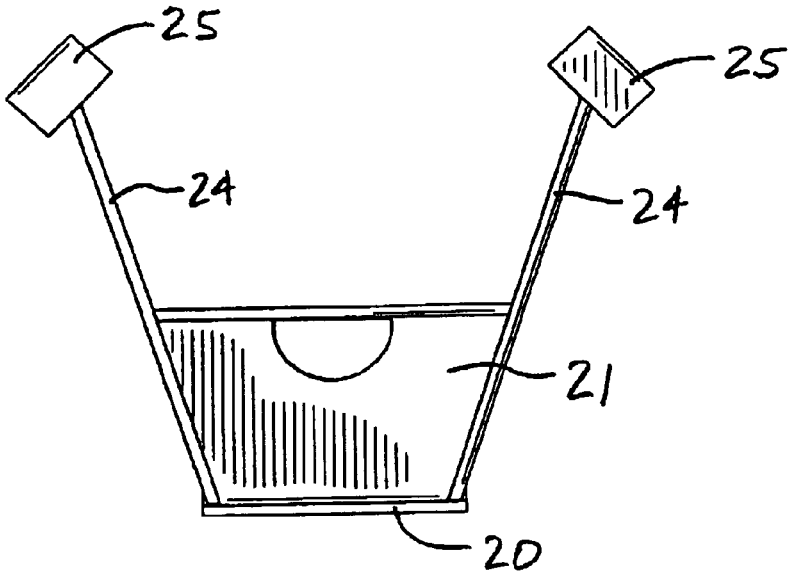
FIG. 4 is a rear elevation of the device of FIG. 3.

A first embodiment of a device 10 in accordance with the present invention for erecting trusses is shown in FIGS. 1–4. The device includes a base or base 20 for a worker to stand on, a back 21, a pair of braces 22, and a pair of support arms 24. The base 20 and the back 21 are generally planar panels joined along a common edge at a right angle to form a chair-like structure. The pair of braces 22 are elongate rod-shaped or beam-shaped members that are spaced apart from each other, across the base 20 and the back 21. The braces 22 are affixed to, and extend between, the free corners of the base 20 and back 21 panels, thereby strengthening the connection between the base and the back, as shown in FIG. 2. The pair of arms 24 are affixed to the back panel 21 at the side edges of the back panel and diverge from each other in the upward direction, as shown in FIGS. 3 and 4, although it is not essential that the arms diverge in this fashion. The upper end of each arm 24 is affixed to a truss grip 25. As shown in FIG. 2, the truss grips 25 each have a wall structure defining a vertically-oriented channel that is sized and angled to mount snugly on a respective truss chord C so as to support the base 20. Advantageously, such a closely conforming fit of the truss grips, as well as the rigid construction of the arms and their rigid attachment to the truss grips, provide stable support for the worker standing on the base so that the arms hold the base in a horizontal orientation, using only the support provided by the chords C of the truss.

The base 20, arms 24, and other portions of the device can be formed of any suitably strong and rigid material. Advantageously, the base comprises a metal plate. The arms can comprise angle iron or metal rods. The truss grips can comprise metal U-shaped channels. Alternatively, the truss grips can be formed by bent upper ends of the arms when the arms comprise metal rods or the like. The important consideration for the truss grips is that the width of the channel that receives the chord of the truss must be only slightly greater than the width of the chord, so that the chord fits closely within the truss grip. The truss grip must engage three sides of the chord, namely, one vertical surface, the top surface, and the other vertical surface, to be able to act in conjunction with the arms to resist the moment on the device tending to rotate the device about the chord, and to prevent the truss grip from slipping off the chord.

Figure 5:
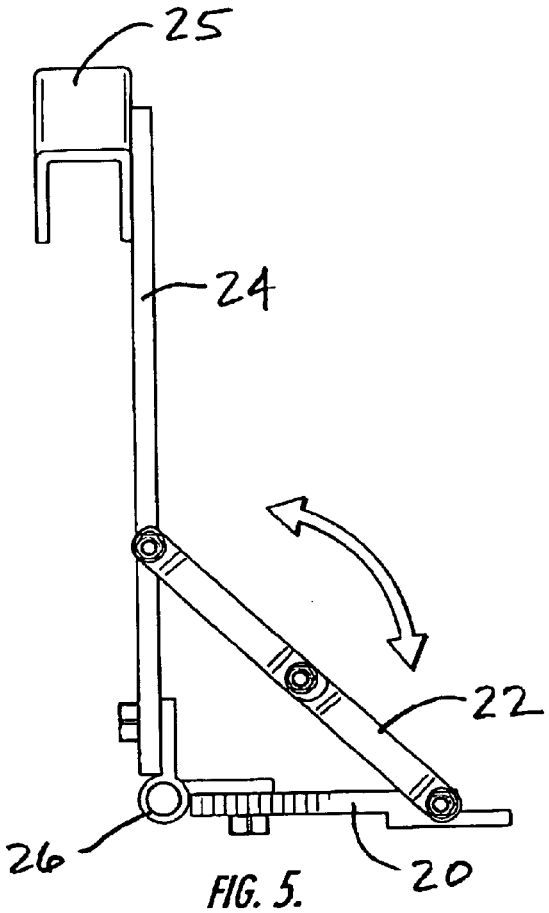
FIG. 5 is a side elevation of a device in accordance with another embodiment of the invention.
Figure 6:
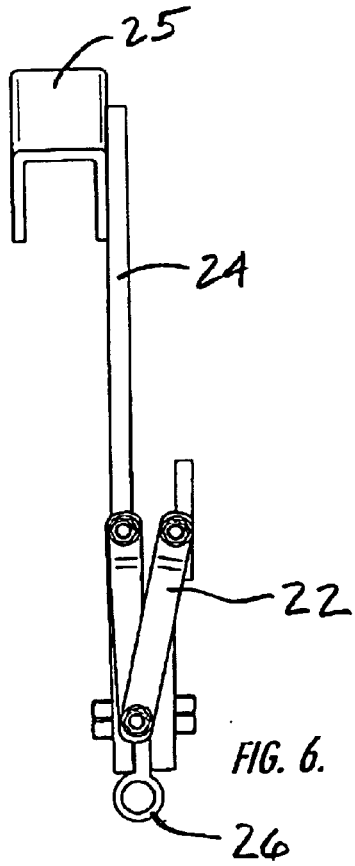
FIG. 6 is a side elevation of the device of FIG. 5, showing a platform of the device in a folded condition.

In another embodiment, shown in FIGS. 5 and 6, the base 20 is connected to the back 21 via a hinge 26, allowing the base to fold upwards into an overlapping arrangement with the back, thus providing a more compact configuration suitable for transportation and storage of the device. In addition, the braces 22 are two-bar linkages that fold into an overlapping arrangement as the base 20 is folded upwards.

Figure 7:
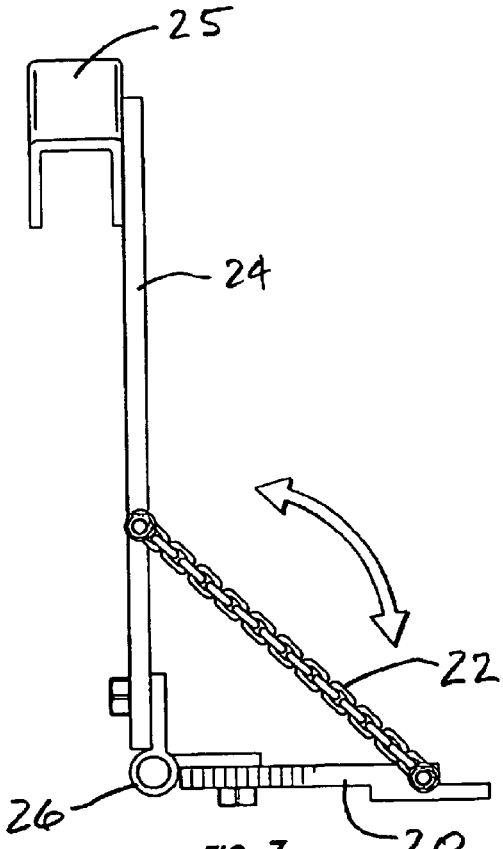
FIG. 7 is a side view of a device in accordance with yet another embodiment of the invention.

FIG. 7 depicts yet another embodiment of a device in accordance with the invention, having a folding base as in the previously describe embodiment. The device of FIG. 7 is the same as that in FIGS. 5 and 6, except the braces 22 comprise flexible support members such as lengths of chain as shown, or cable (not shown), rather than two-bar linkages.

Figure 8:
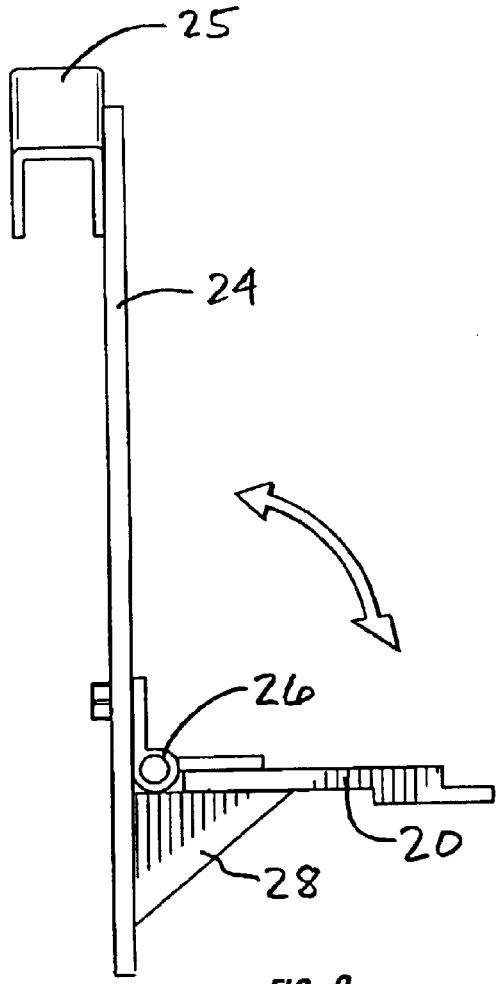
FIG. 8 is a side view of a device in accordance with a further embodiment of the invention.

FIG. 8 shows still another embodiment in accordance with the invention. The device of FIG. 8 has a folding base as in the previous embodiments of FIGS. 5–7. However, rather than employing braces to hold the base in the horizontal, unfolded position, a stop 28 is rigidly affixed to the device beneath the base 20 such that the base abuts the stop when unfolded to the horizontal position. Alternatively, the stop can be affixed to the base in such a position that the stop abuts a downwardly extending portion of the back of the device when the base is unfolded to the horizontal position. In either case, the stop prevents the base from further rotating past the horizontal position.

Figure 9:
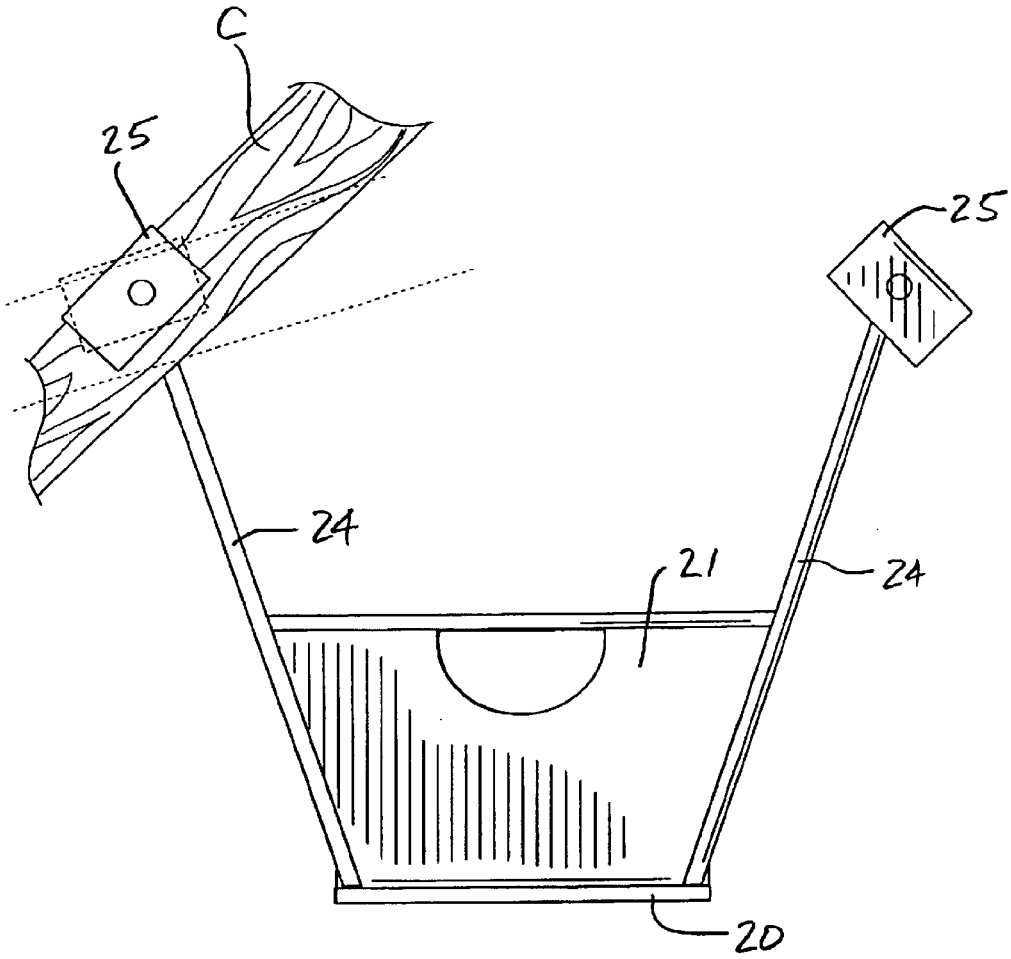
FIG. 9 is a front elevation of a device in accordance with still another embodiment of the invention.

FIG. 9 illustrates a still further embodiment in accordance with the invention. The device of FIG. 9 is similar to that of FIGS. 3 and 4, except the truss grips 25 are not rigidly affixed to the support arms 24. Instead, each truss grip is affixed to its respective arm in such a manner that the grip can pivot relative to the arm about a horizontal axis extending in a front-to-back direction of the device. This allows the truss grip to conform to the angle of inclination of the chord C with which it is engaged, as illustrated by the dashed lines in FIG. 9. This is advantageous, inasmuch as the angle or pitch of the roof trusses can vary from one building structure to another.

A pair of the devices 10 are preferably used by a worker when erecting trusses, as shown in FIGS. 1 and 2. The worker stands on the base 20 of a first one 10 of the devices that is suspended off of a middle truss 200 while working on an end truss 201. The second one 10' of the devices is suspended off of a preceding truss 199 that the worker previously erected. When the worker is finished fixing the end truss 201 in place, the worker leans over the middle truss 200 and lifts the second device 10' off the preceding truss 199. The second device 10' is disengaged from the preceding truss 199 by detaching the truss grips 25. The worker lifts the second device 10' over the middle truss 200 and places the truss grips 25 of the second device on the end truss 201, suspending the second device from the end truss. The worker then can climb over the end truss 201 to stand on the base 20 of the second device 10', thereby providing an ideal position from which to attach a new truss. The process is repeated as the attachment of each new truss is completed.

What is claimed is:

1. A device facilitating the erection of trusses of a building roof frame, comprising:

a base for a worker to stand on;

a pair of support arms attached to the base and extending upwardly therefrom and terminating at upper ends of the support arms, the attachment between the support arms and the base being such that when the support arms are vertical in side view the base is horizontal so as to provide a platform for the worker to stand on;

wherein the base is pivotally attached to the support arms such that the base is pivotable about a horizontal axis between a working position in which the base is horizontal and a storage position in which the base is generally vertical, and further comprising an arrangement for holding the base in the working position against the weight of a worker standing thereon; and a truss grip connected to the upper end of each support arm, the support arms and truss grips being configured such that one of the truss grips is adapted to fit closely over one chord of a truss on one side of a peak thereof and the other truss grip is adapted to fit closely over another chord of the truss on an opposite side of the peak, thereby suspending the base from the truss and positioning the base in a horizontal orientation, the device being structured and arranged such that the device holds the base horizontal against the weight of a worker standing thereon using only the chords as support.

2. The device of claim 1, wherein the arrangement for holding the base in the working position comprises braces connected between the base and the support arms.

3. The device of claim 2, wherein the braces comprises two-bar linkages.

4. The device of claim 2, wherein the braces comprise flexible support members.

5. The device of claim 4, wherein the braces comprise chains.

6. The device of claim 1, wherein the arrangement for holding the base in the working position comprises a stop positioned to prevent pivotal movement of the base past the horizontal working position.

7. The device of claim 1, wherein each truss grip is attached to the respective support arm such that the truss grip is pivotal about a horizontal axis relative to the support arm so as to accommodate roof trusses of various pitches.

8. The device of claim 1, wherein the truss grips are separately formed from the support arms and are subsequently joined to the support arms.

9. A method for erecting roof trusses atop a building structure, comprising the steps of:

suspending a first support platform from a first truss erected atop the building structure, and standing on the first support platform while fixing a second truss atop the building structure adjacent to and spaced from the first truss;

suspending a second support platform from the second truss, and climbing from the first support platform onto the second support platform and standing on the second support platform while fixing a third truss atop the building structure adjacent to and spaced from the second truss; and disengaging the first support platform from the first truss and suspending the first support platform from the third truss, the first and second support platforms thus being alternately used for erecting trusses one after another.

* * * * *